US006280080B1

(12) United States Patent
Puckett, II

(10) Patent No.: US 6,280,080 B1
(45) Date of Patent: Aug. 28, 2001

(54) METHOD FOR AGITATING THE LIQUID CONTENTS OF PAINT BALLS

(76) Inventor: Robert A. Puckett, II, 546 Shades Crest Rd., Birmingham, AL (US) 35226

( * ) Notice: Subject to any disclaimer, the term of this patent is extended or adjusted under 35 U.S.C. 154(b) by 0 days.

(21) Appl. No.: 09/667,865

(22) Filed: Sep. 22, 2000

Related U.S. Application Data

(63) Continuation of application No. 09/212,634, filed on Dec. 16, 1998, now Pat. No. 6,193,410.

(51) Int. Cl.[7] ..... B01F 9/02
(52) U.S. Cl. ..... 366/348
(58) Field of Search ..... 366/208, 209, 366/213, 220, 225, 227, 228, 342, 348, 605

(56) References Cited

U.S. PATENT DOCUMENTS

| | | |
|---|---|---|
| D. 314,021 | 1/1991 | Kuljis . |
| 632,637 | 9/1899 | Brooker . |
| 2,523,258 | 9/1950 | Ransohoff . |
| 2,669,456 | 2/1954 | Hickey . |
| 2,912,803 | 11/1959 | Simjian . |
| 2,994,165 | 8/1961 | Brevik . |
| 3,146,557 | 9/1964 | Smith . |
| 3,553,902 | 1/1971 | Chrsitensen . |
| 4,078,263 | 3/1978 | Campbell . |
| 4,188,130 | 2/1980 | Engels . |
| 4,263,003 | 4/1981 | Vork . |
| 4,491,415 | 1/1985 | Bishop . |
| 4,971,449 | 11/1990 | Hendren . |
| 5,094,715 | 3/1992 | Ljokkoi . |
| 5,166,457 | 11/1992 | Lorenzetti . |
| 5,190,196 | 3/1993 | Hamer, III . |
| 5,259,300 | 11/1993 | Yajima . |
| 5,282,454 | 2/1994 | Bell et al. . |
| 5,320,248 | 6/1994 | Jamieson, III . |
| 5,403,086 | 4/1995 | Lindesay . |
| 5,480,226 | 1/1996 | Milstead . |
| 5,544,642 | 8/1996 | Guthrie . |
| 5,653,625 | 8/1997 | Pierce . |
| 5,695,281 | 12/1997 | Weber et al. . |
| 5,791,325 | 8/1998 | Anderson . |
| 5,794,606 | 8/1998 | Deak . |
| 5,816,232 | 10/1998 | Bell . |
| 5,852,076 | 12/1998 | Serafin et al. . |

OTHER PUBLICATIONS

Gamma Seal TM Lid (no date) advertising flyer.

*Primary Examiner*—Charles E. Cooley
(74) *Attorney, Agent, or Firm*—Morris, Manning & Martin, LLP

(57) ABSTRACT

The invented apparatus can be used to agitate the liquid contents of paint balls to mix and evenly distribute their liquid contents so that the paint balls will fly in a true trajectory when shot from a paint ball gun. The invented apparatus also helps to remove or prevent the formation of dimples on the outer shell of the paint balls caused by sitting for extended periods of time in storage boxes, for example. The invented apparatus can thus be used to repair defective paint balls and to extend the useful life of such paint balls. The apparatus includes a support member, a motor, and a container . The motor is mounted to the support member, and the container is supported for rotation by the support member and the motor's drive shaft. Paint balls are placed in the container which is rotated by the motor during operation of the apparatus to move the paint balls to agitate their liquid contents. The invention also includes a related method.

6 Claims, 5 Drawing Sheets

METHOD FOR AGITATING THE LIQUID CONTENTS OF PAINT BALLS

CROSS REFERENCES TO RELATED APPLICATIONS

This application is a continuation of application Ser. No. 09/212,634, filed on Dec. 16, 1998, now U.S. Pat. No. 6,193,410.

FIELD OF THE INVENTION

1. Background of the Invention

The invented apparatus and methods pertain to the sport of paint ball which has been receiving growing popularity. In most paint ball sports events, each player has a gun loaded with paint balls which the player shoots at opposing players. The paint balls splatter upon impact and can be used to easily determine whether a player has been eliminated or not from the game.

2. Description of the Related Art

Paint balls are essentially spheres with gelatin or other breakable outer material shells that encapsulate liquid paint or dye. After manufacture, paint balls often sit in storage boxes for extended periods of time. The inventor has been found that over time the heavier constituents of the paint balls' liquid contents will settle under gravity, causing the weight of the paint ball to become unevenly distributed. Also, the outer coatings of paint balls can develop dimples by sitting in the same position for substantial periods of time in storage boxes, for example. The uneven weight distribution and/or dimples of the paint balls cause them to fly erratically when shot from the gun, or to jam when feeding into the gun. In addition, uneven weight distribution or dimples in the paint balls can cause the paint balls to fly too fast or too slowly from the gun. Immediately before and after a paint ball game, the velocities at which the paint balls are shot from the players' guns are tested by referees using a chronograph, and if a player's gun fires at velocities over a specified limit, the player is disqualified from the game or penalized. Conversely, a paint ball which shoots too slowly from a gun can cause a player too miss opportunities to hit opposing players during the game. There is currently no device or method available for solving the settling or dimple problems that occur when storing paint balls. It would be desirable to provide an apparatus and method which can overcome these problems.

SUMMARY OF THE INVENTION

The present invention overcomes the above-noted disadvantages. The invented apparatus includes a support member, a motor, and a container. The motor is mounted to the support member, and the container is coupled to and supported for rotation by the support member and the motor's drive shaft. Paint balls are placed in the container, and the apparatus is operated by activating the motor to rotate the container via the drive shaft, causing the paint balls to move with the container. As the paint balls move, their liquid contents are agitated and mixed so that the weights of the paint balls become evenly distributed. In addition, after moving the paint balls in the container, the paint balls are likely to be resting in different positions than before the container was rotated, a fact which helps to prevent the formation of dimples that would cause the paint ball to jam in a paint ball gun or to fly erratically when shot from the gun. Also, the rolling action of the paint balls as the apparatus' container moves helps to "work out" dimples in the paint balls by the centrifugal force of the paint ball's liquid contents which push the dimples in the paint balls' shells outwardly relative to the paint balls' center to cause the shells to assume dimple-free spherical shapes. The invented apparatus can therefore be used to extend the useful life of paint balls by repairing dimpled paint balls and by mixing the paint balls' liquid contents to become more evenly distributed so that the paint balls will fly in true trajectories at consistent velocities without jamming in paint ball guns.

In the preferred embodiments of the invented apparatus, the motor is driven by an electric power source such as a wall outlet or car battery. The apparatus can include a switch mounted to the support member, which can be operated by a user to electrically couple or decouple the motor from the power source to commence or stop rotation of the container, respectively. The apparatus can also include a timer unit electrically coupled between the motor and the power source, which can be set by a user to supply power from the source to the motor for a predetermined period of time, preferably from ten to fifteen minutes for relatively recently-manufactured paint balls, and from several hours to days for older paint balls. In addition, the timer unit can be set by a user to rotate the container for the predetermined time period repeatedly at a predetermined time interval, such as on a daily basis, for example. The apparatus can also include a transformer electrically coupled between the power source and the motor, that converts the voltage and current level of the power source (typically a wall outlet or a 12-volt car battery) to a voltage and current level that are compatible with the motor. In addition, if the power source generates an alternating-current (AC) electric power and the motor operates on direct current (DC) electric power, the apparatus can include a rectifier coupled between the power source and the motor, to convert the AC power to DC power appropriate for the DC motor. To avoid risk of damaging the paint balls, the motor preferably rotates the container at from one-quarter (¼) to twenty (20) revolutions per minute (RPM), the most preferred range being between six (6) and eight (8) RPMs.

In one preferred embodiment of the invented apparatus, the support member is approximately U-shaped cross-section and includes first and second rigid planar opposing side members, and a rigid planar base member extending between the first and second side members. The base member serves to support the apparatus on a surface such as a table top or floor, for example. The motor is mounted for support to the first side member. The apparatus further includes a support shaft that is rotatably mounted to the second side member, which engages with the container. The container is supported between the motor's drive shaft and the support shaft both for support and to permit rotation of the container relative to the support member. The container preferably has the shape of a rectangular box sized to receive a standard-size case of paint balls. The container can include a first part that has rigid planar first and second side, rear and bottom portions, with the first side portion being coupled to the drive shaft and with the second side portion coupled to the support shaft. The container can also include a second part that defines rigid planar top and front portions of the container. The container can further include a hinge attached between the first and second parts, to allow a user to rotate the second part relative to the first part to open or close the container. In addition, the container can include a securing device such as a latch to releasably secure the first and second parts together to secure the container in its closed position.

In a second embodiment of the invented apparatus, the support member is approximately U-shaped in cross-section and includes opposing rigid planar front and rear members, and a rigid planar base member extending between the front and rear members. The base member serves to support the apparatus on a surface. The motor is mounted to the rear member. The apparatus further includes first and second wheels rotatably mounted to the front member in a spaced relationship. In the second embodiment, the container includes a bucket for containing the paint balls, which has a cylindrical side surface and a planar bottom surface. The bottom surface defines a keyed recess that receives the drive shaft of the motor. The cylindrical surface contacts the first and second wheels to support the container, and is driven by the motor via the drive shaft in contact with the first and second wheels to rotate the bucket and the paint balls contained therein during operation of the apparatus. The bucket can include a lid which can be removably secured to the open top of the bucket to contain paint balls therein so that they will not be spilled out of the bucket during operation of the apparatus. Preferably, the bucket includes at least one agitator attached to an inner surface of the bucket, to move the paint balls as the bucket is rotated by the motor. The agitator is preferably composed of soft material such as neoprene or foam rubber to avoid damaging the paint balls, and has a spiral configuration. Also preferred, the bucket can be lined with a soft material such as neoprene to prevent the paint balls from being damaged. When the motor is stopped, the bucket can be pulled by hand away from and clear of the drive shaft and the wheels, and the bucket can be set upon its bottom surface in an upright position from which the paint balls can be readily retrieved for use in paint ball guns.

The invented method includes a step of placing paint balls in a container, and a step of moving the container to put the paint balls in motion to agitate the liquid contents thereof. The agitation of the paint balls' liquid contents mixes such contents so that their weights are evenly distributed, and also causes the paint balls' contents to push outwardly from the paint balls' center by centrifugal force to push out dimples formed in the paint balls' outer shells. In addition, after moving the paint balls in the container, it is likely that the paint balls will come to rest in a different position than they had prior to moving the container so that the formation of dimples on the paint balls is prevented in the invented method.

These together with other features and advantages, which will become subsequently apparent, reside in the details of construction and operation as more fully hereinafter described and claimed, reference being made to the accompanying drawings, forming a part hereof wherein like numerals refer to like parts throughout the several views.

DESCRIPTION OF THE PREFERRED EMBODIMENTS

As used herein, the terms "mounted", "coupled", "attached" or "engaged" refer to the joining of two elements together, whether in a fixed or releasable manner, through any device or technique, such as through rivets, pins, screws, nuts and bolts, adhesives, welding, fusing, releasable couplers, keyed interlocking parts, or by forming the elements integrally together when manufactured. "Electrically coupled" refers to coupling two elements together, such as by conductive wire cord, so as to actually pass or provide the capability to pass electric power therethrough. "Electrically decoupled" refers to disabling two elements from passing electric power therebetween.

Figure 1:
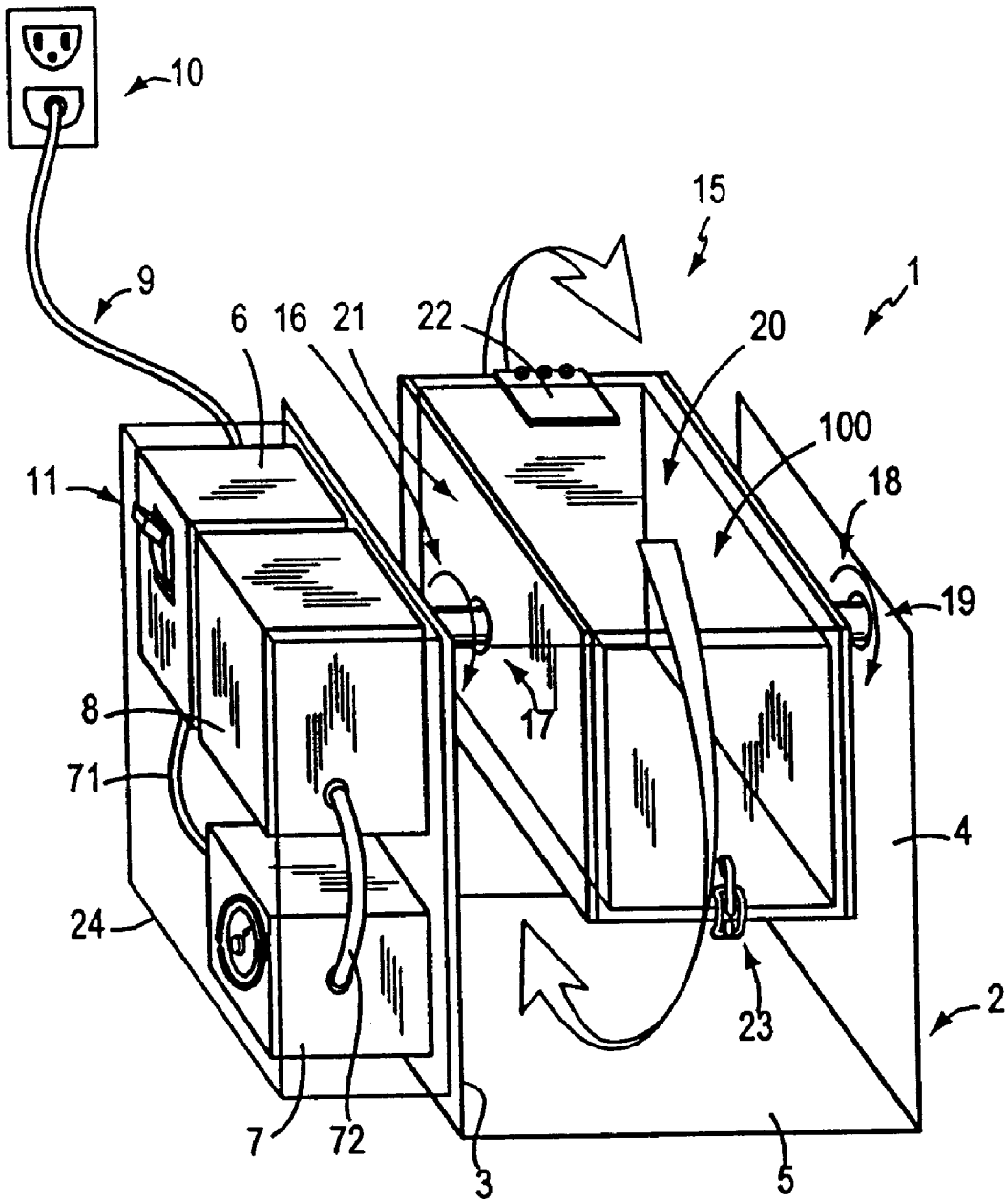
FIG. 1 is a perspective view of a first embodiment of the invented apparatus with the container in its closed position.

Referring to FIG. 1, a first embodiment of the invented apparatus 1 is shown. The apparatus 1 includes a support member 2 which preferably has an approximately U-shaped cross-section, and which includes two spaced and opposing rigid planar side members 3, 4, and a rigid planar base member 5 extending between the side members. The members 3, 4, 5 are preferably composed of a rigid material such as aluminum, steel or other metal, or a plastic such as polycarbonate, polyvinyl chloride (PVC), or vinyl, for example. The members 3, 4, 5 can be formed as an integral molded, extruded or cast piece of material, or in the case of a metal, can be formed from a single piece of metal that is bent to define the members 3, 4, 5. Alternatively, the members 3, 4, 5 can be cut, cast or molded as different material pieces and attached together at their edges to form the support member 2. The apparatus 1 also preferably includes a switch unit 6, a timer unit 7, and a motor 8. The units 6, 7, 8 can be mounted to the side member 3. The switch unit 6 is electrically coupled to an electrical connection cord 9 to a power source 10 such as a car battery (possibly via the car's cigarette lighter) or a wall outlet. The switch unit 6 includes a switch 11 electrically coupled to the cord 9, which can be switched between an "off" state in which the electrical connection to the cord 9 is opened to prevent the passage of electric power, and an "on" state in which the switch 11 permits electric power to pass therethrough. The switch 11 can be a wall switch or other conventional device. Preferably, the switch unit 6 also includes a fuse 12 (not shown in FIG. 1, but shown in FIG. 5) that is electrically coupled between the switch 11 and the timer unit 7, and which opens the electrical connection between the switch 11 and the timer unit 7 if subjected to relatively high electric current to protect the apparatus 1 from surges in the electrical power supplied by the source. In addition, if the power source generates AC power and the motor 8 operates on DC power, the apparatus 1 can include a rectifier 61 (not shown in FIG. 1, but shown in FIG. 5), preferably coupled between the power source 10 and the switch 11, that converts the AC power into DC power appropriate for the motor. In addition to or in lieu of the rectifier 61, the apparatus 1 can include a transformer 62 (not shown in FIG. 1, but shown in FIG. 5) that is preferably electrically coupled between the power source 10 and the switch unit 6, which converts the voltage and current level of the power source 10 into a voltage and current level appropriate for the motor 8. If the power source 10 utilized with the apparatus 1 is a twelve-volt car battery and the motor 8 is a twelve-volt DC motor, generally, neither the rectifier 61 nor the transformer 62 are necessary and can be omitted to simplify the apparatus and its construction, as well as to reduce the cost of the apparatus 1. Similarly, if the power source 10 is a standard wall outlet with 115-Volt AC power, a 115-Volt AC motor can be used without the rectifier 61 or the transformer 62.

The timer unit 7 is electrically coupled to the switch unit 6 via electrical cord 71 to receive electric power therefrom when the switch 11 is turned to its "on" state and the fuse 12 is intact so that electric power can flow therethrough. The timer unit 7 serves to supply power to the motor 8 for a limited period of time as predetermined by a user of the apparatus by appropriately setting the timer with a dial or input keys, for example. In general, it is preferred that this period of time be from ten (10) to fifteen (15) minutes for relatively recently-manufactured paint balls (i.e., paint balls that are less than a few months old), but for older paint balls, the timer is preferably activated to supply electric power to the motor 8 for a time period of several hours to a few days. In addition, the timer unit 7 can also be such as to permit the power to be supplied to the motor 8 repeatedly at a predetermined time interval, as preset by the user using the apparatus 1 with the timer unit 7. For example, the timer unit can be set to supply power to the motor unit 8 for a predetermined time period such as ten to fifteen minutes repeatedly on a daily interval basis. The timer unit 7 can be one of a variety of commercially available devices, such as those used for swimming pool pump systems, lawn watering or outdoor lighting, for example.

The timer unit 7 is electrically coupled to the motor 8 via electrical connection cord 72. The motor 8 can be a commercially available device, such as a 1/60th horse power, 6-RPM, 72 inch-lb. work starting and running, 115-Volt AC motor which is widely available from a number of commercial sources. Alternatively, the motor 8 can be a 12-Volt DC motor with similar horse power and RPM characteristics as that of the AC motor described immediately above. The motor 8 is preferred to have sufficiently low power so as to stop if a user accidentally inserts a hand or arm, for example, between moving parts of the apparatus 1, and yet should have sufficient power to move the apparatus' container 15 effectively when unobstructed. The motor 8 operates on the electric power it receives to rotate its drive shaft 16. The motor 8 can be either directly coupled to the drive shaft 16 or can be coupled indirectly to the drive shaft 16 through gears which can be used to speed up or slow down the rotation of the drive shaft 16 relative to the rotation rate of the motor 8.

The apparatus 1 also includes a container 15 for holding paint balls. The container 15 can be composed of a variety of materials, including metals and plastics. In this embodiment of the invented apparatus 1, the container 15 is configured to hold a case of paint balls 100. The case 100 is shown in broken line in FIG. 1 to represent the fact that the case of paint balls is positioned inside of the container 15 and thus would not be visible in the view of FIG. 1. The current standard size for paint ball cases is approximately 8×12×18 inches, so the container 15 is preferably one-quarter to one inch larger in each dimension as compared to the paint ball case size. If retail paint ball packaging changes in the future, the container 15, and the apparatus 1 in general, can be readily resized to adapt to such changes in retail paint ball packaging. The drive shaft 16 of the motor 8 extends through the side member 3, optionally through a bearing (not shown) mounted in the side member 3 which is attached to and supports the drive shaft 16. The drive shaft 16 engages with a side portion of the container 15. The end of the drive shaft 16 can be welded to the container 15, or alternatively, the drive shaft 16 can be releasably connected to the container 15 using a keyed recess 17 with a slotted, star or asterisk shape, for example, for which the end of the drive shaft is correspondingly configured so that the drive shaft can be fitted to the recess 17 to drive the container 15 to rotate. In another alternative configuration, the drive shaft 16 can be connected to the container 15 with a quick-release coupler, for example. The latter two options permit the container 15 to be removed from or coupled to the drive shaft 16 as desired, and can also permit the use of containers 15 with different sizes. On the side portion of the container 15 opposite the side portion that engages with the drive shaft 16, the container 15 engages with a support shaft 18 of the apparatus 1. The support shaft 18 is supported by the side member 4 either in direct contact therewith or through the use of a bearing 19 mounted in the side member 4 through which the support member 18 extends and to which the support member is fixed by welding or adhesive, for example. Similar to the drive shaft 16, the support shaft 18 can either be attached to the side of the container 15, or engaged therewith with a key formed at the end of the support shaft 18 which engages in a correspondingly keyed recess in the side of the container 15, or via a quick-release coupler, for example, to permit the container to be removed from the remainder of the apparatus 1. The drive shaft 16 and the support member 18 are aligned along a common axis about which the container 15 is rotated relative to the support member 2 by the motor 8 during operation of the apparatus 1, as shown by the direction arrows in FIG. 1.

In this embodiment of the invented apparatus, the container 15 preferably includes two parts 20, 21, preferably made of rigid metal or plastic. The part 20 constitutes the front and top planar portions of the container 15, whereas the part 21 constitutes the two opposing planar side portions, and the planar rear and bottom portions of the container 15 in the view of FIG. 1. The container 15 also preferably includes a hinge 22 attached between the parts 20, 21 to allow the part 20 to be rotated relative to the part 21 to open or close the container 15. To secure the container 15 in its closed position, the container 15 includes a securing device 23 which can be any of a wide variety of devices. For example, the securing device 23 can include a wire loop pivotally mounted to a lever which in turn is pivotally mounted to the front portion of the first part 20. The wire loop can be engaged with a protrusion of rigid material such as metal, that is mounted to the front edge of the bottom portion of the second part 21. By turning the lever against the front portion of the first part 20, the wire loop can be tightened about the protrusion to secure the first and second parts 20, 21 together.

Figure 2:
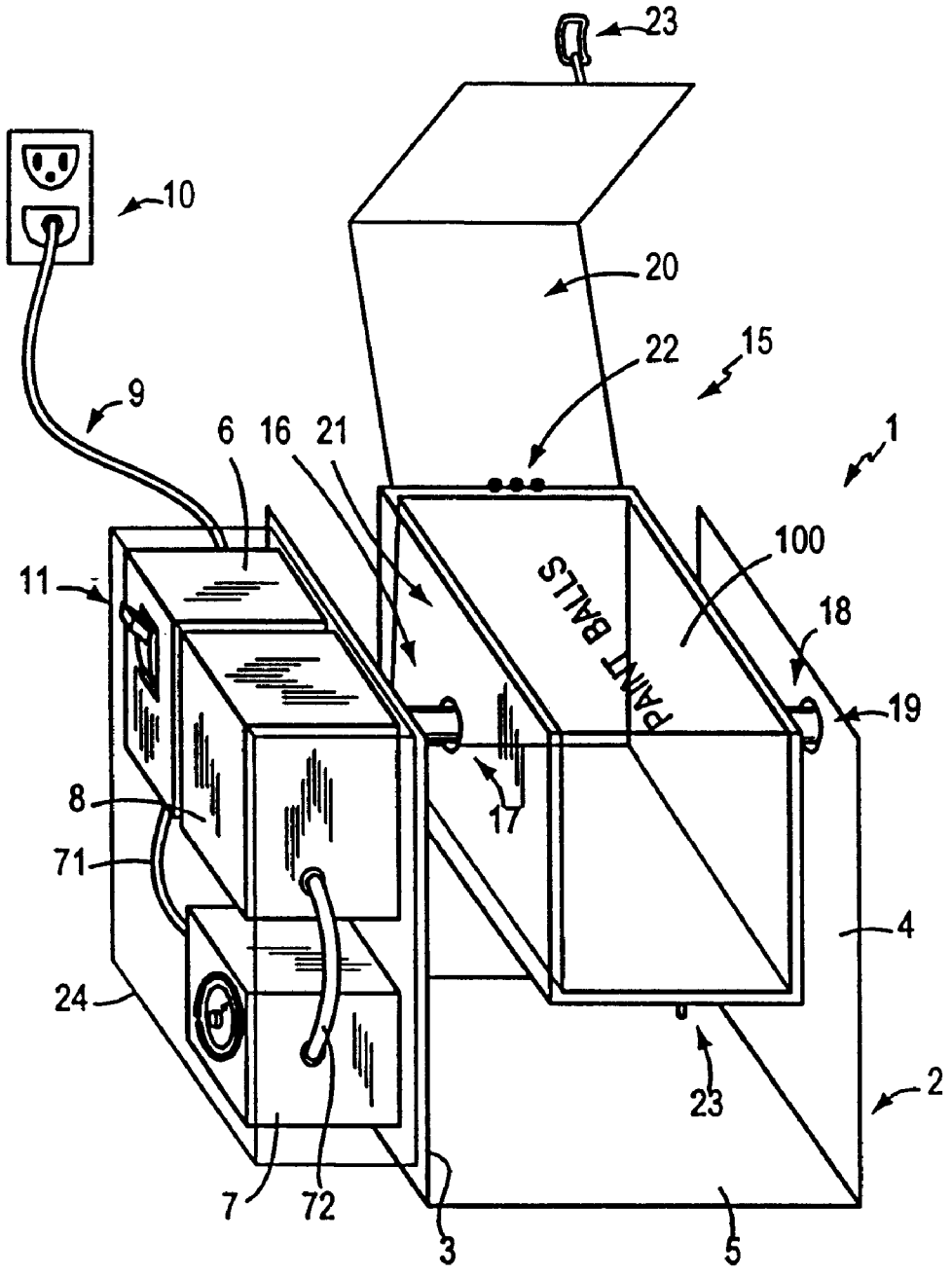
FIG. 2 is a perspective view of the first embodiment of the invented apparatus with the container in its opened position.

FIG. 2 shows the apparatus 1 with the container 15 in its opened position. More specifically, in FIG. 2, the securing device 23 is released and the first part 20 is rotated about hinge 22 relative to the second part 21 to the container's opened position to reveal the case of paint balls 100 held inside of the container 15.

The apparatus 1 of FIGS. 1 and 2 can include an enclosure 24 mounted to the side member 3, which is illustrated in broken line to indicate in this case that the enclosure is an optional feature of the invented apparatus 1. The enclosure 24 serves to protect the switch unit 6, the timer unit 7 and the motor 8 and can also be used to provide an attractive appearance for the apparatus 1. The enclosure 24 substantially encloses the switch unit 6, the timer unit 7, and the motor 8, but preferably defines openings to permit the switch 11 and the timer unit 7 to be accessed and operated by a user.

In operation of the apparatus 1 of FIGS. 1 and 2, a case of paint balls 100 is loaded by hand into the second part of the container 15 so that the case is positioned as shown in FIG. 2. The timer unit 7 is set as desired by a user so that the motor will operate for a predetermined time period. Optionally, the timer unit 7 can be such as to be set by the user to switch the motor between its "on" and "off" states at predetermined regular time intervals as desired by the user, such as at daily time intervals. The first part 20 is rotated about hinge 22 to enclose the case 100 between the first and second parts 20, 21, and the securing device 23 is secured to hold together the first and second parts 20, 21 in the container's closed position. The switch 11 is then turned from its "off" state to its "on" state to permit electric power to pass to the timer unit 7 to start operation of the apparatus 1. The timer unit 7 tracks the time and supplies electric power to the motor unit 8 during the time period for which the timer unit has been set. When supplied with power from the timer unit 7, the motor 8 rotates its drive shaft 16 to cause the container 15 and the paint balls contained therein to rotate. As the container 15 rotates, the contents of the paint balls are agitated to cause the constituents of their liquid contents to be evenly distributed therein after sufficient rotation of the container 15. In addition, the rotation of the paint balls causes their liquid contents to push dimples outwardly relative to the center of the paint balls due to centrifugal force, to remove the dimples and restore the paint balls to the desired spherical shape. Upon expiration of the time period for which the timer unit 7 has been set, the timer unit cuts off electric power to the motor unit 8 to stop the motor from rotating the container 15. The switch 111 can be moved from its "on" to its "off" state, the securing device 23 can be released, and the container opened to extract the case of paint balls 100 for use in paint ball guns.

Figure 3:
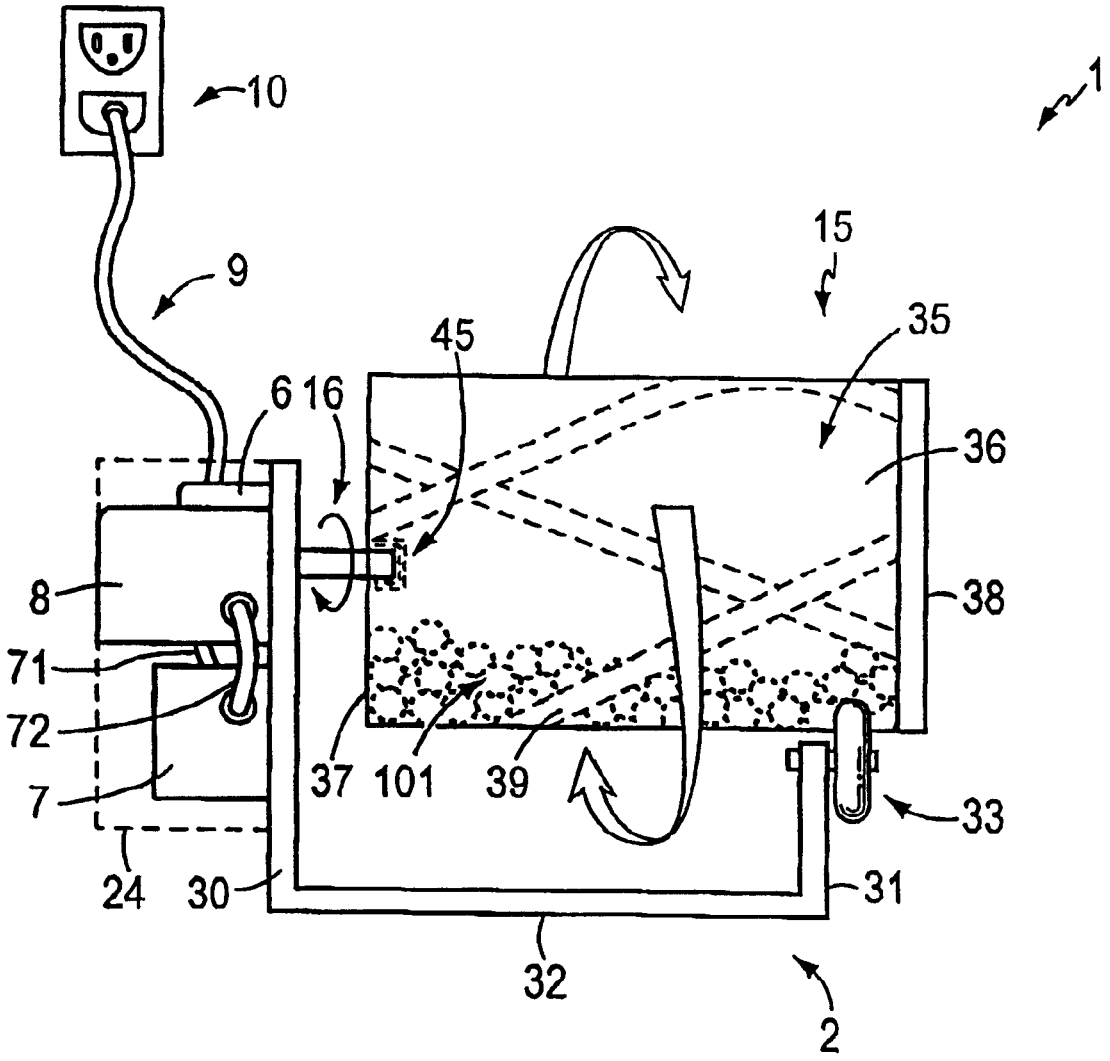
FIG. 3 is a side elevational view of the second embodiment of the invented apparatus.
Figure 4:
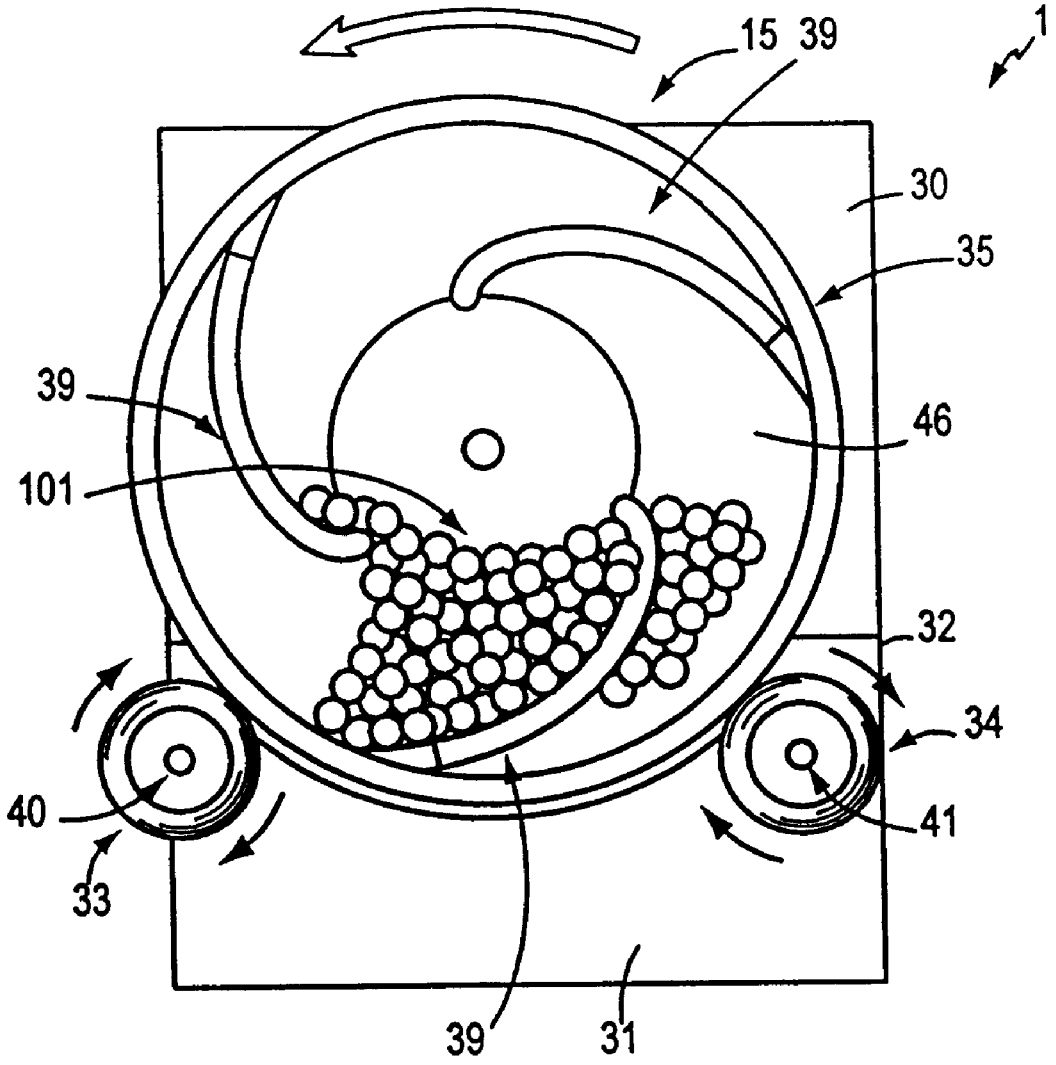
FIG. 4 is a front elevational view of the second embodiment of the invented apparatus.

The second embodiment of the invented apparatus 1 is shown in FIGS. 3 and 4. In FIG. 3, the apparatus 1 includes the switch unit 6, the timer unit 7, a motor 8, electrical connection cords 9, 71, 72, and optionally an enclosure 24, as described with reference to the first embodiment of the invention. In the second embodiment of the invented apparatus 1, the support member 2 is configured somewhat differently as compared to that of the apparatus' first embodiment. More specifically, the support member 2 includes rigid planar opposing rear and front members 30, 31, and a rigid planar base member 32 which extends between the rear and front members 30, 31. The base member 32 serves to support the apparatus 1 on a surface. The switch unit 6, the timer unit 7, the motor 8 and the enclosure 24 are mounted to the rear member 30, and the drive shaft 16 of the motor preferably extends through the member 30. The front member 31 has two wheels 33, 34 (only wheel 33 is visible in FIG. 3) rotatably mounted thereto at spaced positions. In the second embodiment of the invented apparatus 1, the container 15 includes a bucket 35 in which are placed paint balls 101. The paint balls 101 are indicated in broken line to indicate that they are positioned inside of the bucket and would thus not be visible in the view of FIG. 3. The bucket 35 includes a cylindrical side surface 36 with a bottom end closed by planar bottom surface 37. The bucket 35 can be composed of rigid material such as plastic or metal. The bottom surface 37 defines a keyed recess 45 which corresponds to the keyed end of drive shaft 16 so that the bucket 35 will rotate about its symmetrical axis when driven by the motor 8 as shown by the direction arrows in FIG. 3. To hold the paint balls 101 inside of the bucket 35, the container 15 can include a lid 38 which can be force-fitted or threaded to the open end of the bucket. The bucket 35 with threaded lid 38 are commercially available from a variety of sources, such as Gamma Plastics™, Inc. of San Diego, Calif. On the interior surface of the bucket 35, the container 15 can include one or more agitators 39 (in the example of FIG. 3 there are three) that are illustrated in broken line in FIG. 3 to indicate that they are inside of the bucket and thus could not be seen in the view of FIG. 3. The agitators 39 are elongated members that serve to urge the paint balls 101 to move as the bucket 35 rotates when driven by the motor 8. The agitators 39 extend along the inside of the bucket from the top to the bottom thereof. The agitators 39 also extend from the cylindrical inner surface of the bucket toward the bucket's central axis, preferably for a distance of one-quarter to a few inches. The agitators 39 are preferably made of a soft material such as foam rubber, neoprene or soft curable plastic material, to avoid damaging the paint balls 101. The agitators 39 can be formed by molding or extruding a curable soft plastic material with a mold, die or by hand, or by cutting a larger sheet of material such as neoprene or foam rubber to size to produce the agitators. The agitators 39 can be attached to the inside surface of the bucket 35 with an adhesive, for example, or can be composed of a material which adheres to the bucket's side when cured. The agitators 39 are preferably spiral-shaped, with bottom ends positioned more forwardly with respect to the direction of rotation of the bucket 35 (see direction arrows) as compared to the top ends of the agitators. This disposition of the agitators 39 urges the paint balls 101 toward the top of the bucket 35 (i.e., to the right in FIG. 3). Because the wheels 33, 34 and drive shaft 16 preferably hold the bucket 35 so that its top portion is more elevated as compared to its bottom portion, the paint balls will normally tend to roll toward the bottom of the bucket 35 (i.e., toward the left in FIG. 3). With their spiral configurations, the agitators 39 counteract the effects of gravity to force the paint balls to the right in FIG. 3 to more evenly distribute the paint balls along the bucket's cylindrical side surface so that the paint balls do not tend to pile up in the bottom of the bucket during operation of the apparatus. Each agitator 39 preferably extends along a portion of the circumference of the bucket's cylindrical surface that is at least approximately equal to the total circumference (i.e., 360 degrees) divided by the total number of agitators used. Thus, in the example of FIG. 4, each of the three agitators 39 extends along 120 degrees, or in other words one-third, of the total circumference of the bucket's cylindrical surface. The inside surface of the bucket 35 can be lined with soft or sponge-like sheet material 46 (shown in FIG. 4) such as neoprene or foam rubber, to cushion the paint balls 101 as the bucket 35 rotates to prevent the paint balls from being damaged.

FIG. 4 is a view of the apparatus 1 which shows the agitators 39 attached to the inside of the bucket 35. In addition, FIG. 4 shows the wheels 33, 34 engaging with and supporting the bucket's cylindrical surface on opposite sides thereof. The wheels 33, 34 rotate in contact with the bucket's cylindrical surface as the motor 8 drives the bucket to rotate via the drive shaft 16 and the keyed recess 45 defined in the bucket's bottom surface. The wheels 33, 34 are rotatably mounted to the member 31, optionally using respective bearings 40, 41 which extend through and are secured to the member 31 with respective bolts or the like. The wheels 33, 34 preferably have surfaces with sufficient traction to avoid slipping in contact with the container 15. For example, the wheels 33, 34 can have rubber surfaces, for example, to provide ample traction with the bucket 35.

In operation of the embodiment of the apparatus 1 shown in FIGS. 3 and 4, paint balls 101 are placed inside of the bucket 35. The keyed recess 45 of the bucket is inserted on the drive shaft 16, and the bucket is positioned between and in contact with the wheels 33, 34. The timer unit 7 is set as appropriate to operate the motor for a predetermined time period. Optionally, the timer unit 7 can also be set to operate at predetermined regular time intervals, such as on a daily basis. The switch 11 is then turned from its "off" state to its "on" state to permit electric power to pass to the timer unit 7 to start operation of the apparatus 1. When supplied with power from the timer unit 7 during the set time period, the motor 8 rotates its drive shaft 16 to cause the bucket 35 and the paint balls therein to rotate. Preferably, the motor 8 rotates the bucket at approximately one-quarter (¼) to twenty (20) RPM, and most preferably, from six (6) to eight (8) RPM. As the bucket 35 rotates, the agitators 39 move into contact with the paint balls 101 to cause them to roll so that the contents of the paint balls are agitated and the constituent parts of the paint balls' liquid contents become more evenly distributed. In addition, the rolling of the paint balls causes the liquid contents thereof to force out dimples by pushing in a direction outwardly from the centers of the paint balls outwardly to force out the dimples. When the paint balls are desired to be extracted from the bucket 35 for use, the switch 11 can be moved from its "on" state to its "off" state and the bucket 35 can be lifted away from the drive shaft 16 and the wheels 33, 34 and set upon its bottom surface to permit paint balls to be extracted for use in paint ball guns. Because the liquid contents of the paint balls 101 are mixed by the invented apparatus 1 so that the weight of their liquid contents is evenly distributed, and because dimples are worked out of the paint balls' shells, the paint balls will fly in a true trajectory when shot from a paint ball gun and will not tend to jam therein. Furthermore, through use of the apparatus 1, the paint balls can be assured to be substantially spherical so that they will fly at consistent speeds from the gun to avoid chronograph fouls from guns which shoot at impermissibly high velocities, and conversely, provide the player with assurance that the paint balls will not fly too slowly so that the player has the capability to readily hit opposing players with paint balls shot from the gun.

Figure 5:
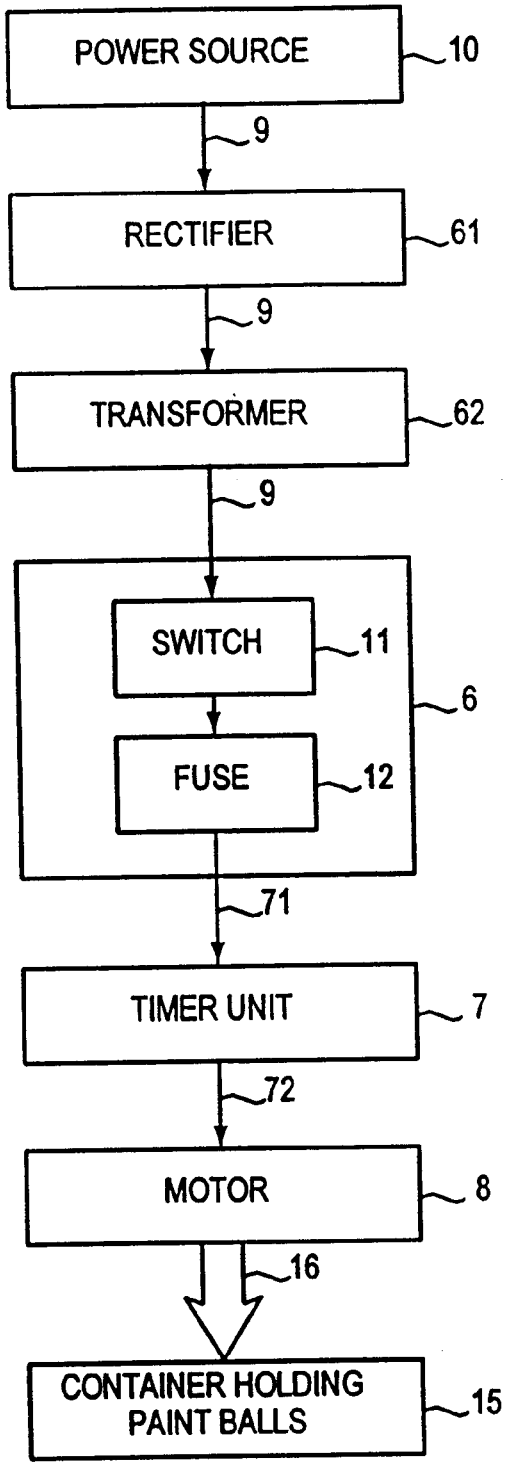
FIG. 5 is a block diagram of the invented apparatus.

FIG. 5 shows a block diagram of the basic elements of the invented apparatus 1 which are common to both the first embodiment of FIGS. 1 and 2, and the second embodiment of FIGS. 3 and 4. In FIG. 5, the power source 10 is electrically coupled to the switch unit 6, and more specifically, to the switch 11, via the connection cord 9 (the switch unit 6 is indicated in broken line to indicate that it is an optional feature of the apparatus, although its use is preferred). Optionally, if the power source 10 is an AC source and the motor operates on DC power, the rectifier 61 can be used to convert the AC power of the source 10 into DC power appropriate for the motor 8. The rectifier 61 and the transformer 62 are indicated in broken lines in FIG. 5 to indicate that they are optional features of the invention. Also, if the motor 8 operates at a different voltage and current level than that of the power source 10, a transformer 62 can be coupled between the source 10 and the motor 8 to convert the voltage and current level of the source 10 into voltage and current levels appropriate for the motor 8. The switch 11 is electrically coupled to the fuse 12 which is in turn electrically coupled to the timer unit 7 via the electrical connection cord 71. The timer unit 7 is electrically coupled to the motor 8 (the timer unit 7 is also indicated in broken line in FIG. 5 to indicate that it is an optional feature of the apparatus). The motor 8 is mechanically coupled via its drive shaft 16 to the container 15 to rotate the container when supplied with power from the switch unit 6 and the timer unit 7.

The invented method includes a step of placing paint balls in a container, and a step of moving the container to in turn move the paint balls to agitate their liquid contents. Preferably, the moving step is performed by an apparatus which may be such as those described with reference to FIGS. 1–5. The paint balls can be placed in the container either loosely or in a case or other retail packaging used for shipment and storage of paint balls. The container can be either a rectangular box sized to receive a case of paint balls, or can be a bucket. The bucket can include at least one agitator to move the paint balls in the performance of the moving step. The moving step can be performed by rotating the container. Preferably, the paint balls are moved in the moving step for a predetermined period of time, such as ten to fifteen minutes for relatively newly-manufactured paint balls, and from several hours to a few days for older paint balls. In addition, the moving step can be performed at a regular time interval, such as on a daily basis.

The many features and advantages of the present invention are apparent from the detailed specification and thus, it is intended by the appended claims to cover all such features and advantages of the described apparatus and method which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

What is claimed is:

1. A method comprising the steps of:

(a) placing a case of paint balls in a container of an apparatus, each paint ball having liquid contents therein; and (b) moving the container with a motor of the apparatus to move the paint balls to agitate the liquid contents thereof and to work out dimples in the paint balls.

2. A method comprising the steps of:

(a) placing paint balls in a bucket of an apparatus, the container being a bucket, each paint ball having liquid contents therein; and (b) moving the bucket with a motor of the apparatus to move the paint balls to agitate the liquid contents thereof and to work out dimples in the paint balls.

3. A method as claimed in claim 2, wherein the bucket includes at least one agitator to move the paint balls as the container is moved in said step (b).

4. A method comprising the steps of:

(a) placing paint balls in a container of an apparatus, each paint ball having liquid contents therein; and (b) moving the container with a motor of the apparatus for a predetermined period of time to agitate the liquid contents of the paint balls and to roll the paint balls in the container for the predetermined period of time to remove dimples from the paint balls.

5. A method comprising the steps of:

(a) placing paint balls in a container of an apparatus, each paint ball having liquid contents therein; and (b) rotating the container with a motor of the apparatus for a predetermined period of time to agitate the liquid contents of the paint balls to remove dimples from the paint balls.

6. A method applied to paint balls prior to loading the paint balls in a paint ball gun comprising the steps of:

(a) placing paint balls in a container of an apparatus, each paint ball having liquid contents therein; and (b) rotating the container with a motor of the apparatus to roll the paint balls in the container for a predetermined period of time to effectuate agitation of the liquid contents to distribute constituent parts of the liquid contents to remove dimples from the paint balls.

* * * * *